US006869253B2

(12) United States Patent
Biolley

(10) Patent No.: US 6,869,253 B2
(45) **Date of Patent: *Mar. 22, 2005**

(54) HYBRID RISER OR PIPE FOR FLUID TRANSFER

(75) Inventor: Francis Biolley, Paris (FR)

(73) Assignee: Institut Francais du Petrole, Rueil-Malmaison cedex (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/471,501

(22) Filed: Dec. 23, 1999

(65) Prior Publication Data

US 2002/0060077 A1 May 23, 2002

(30) Foreign Application Priority Data

Dec. 23, 1998 (FR) ..... 98 16413

(51) Int. Cl.[7] ..... E21B 17/01; E21B 43/01

(52) U.S. Cl. ..... 405/224.3; 405/224.2; 166/345; 166/367

(58) Field of Search ..... 405/168.4, 169, 405/170, 172, 224.2, 224.3, 224.4, 195.1; 166/345, 350, 359, 367

(56) References Cited

U.S. PATENT DOCUMENTS

| | | | | | |
|---|---|---|---|---|---|
| 3,461,916 | A | * | 8/1969 | Ledgerwood, Jr. | 405/224.3 |
| 3,602,174 | A | | 8/1971 | Gorman | |
| 4,266,886 | A | * | 5/1981 | Milton | 405/169 |
| 4,279,543 | A | | 7/1981 | Remery | |
| 4,333,828 | A | * | 6/1982 | Taylor | 166/321 |
| 4,371,037 | A | * | 2/1983 | Arnaudeau | 166/367 |
| 4,462,717 | A | * | 7/1984 | Falcimaigne | 166/350 |
| 4,570,716 | A | * | 2/1986 | Genini et al. | 405/169 |
| 4,906,137 | A | * | 3/1990 | Maloberti et al. | 405/170 |
| 5,007,482 | A | * | 4/1991 | Forsyth et al. | 166/345 |
| 5,474,132 | A | | 12/1995 | Gallagher | |
| 5,505,560 | A | * | 4/1996 | Brown et al. | 405/169 |
| 5,615,977 | A | * | 4/1997 | Moses et al. | 405/169 |
| 5,865,566 | A | | 2/1999 | Finn | |
| 5,931,602 | A | * | 8/1999 | Gulbrandsen et al. | 405/224 |

(List continued on next page.)

FOREIGN PATENT DOCUMENTS

| | | |
|---|---|---|
| EP | 390728 | 10/1990 |
| EP | 467635 | 1/1992 |
| GB | 2326177 | 12/1998 |
| GB | GB/2330157 | 4/1999 |
| WO | WO87/01747 | 3/1987 |
| WO | 9507405 | 3/1995 |
| WO | 9721017 | 6/1997 |

OTHER PUBLICATIONS

API Recommended Practice 17B for Flexible Pipe (Section 4.3).

Flexible Risers Used For Balmoral Floater, vol. 46, No. 8 aout 1986, p. 76, 79, 80 Figure 1.

*Primary Examiner*—Thomas B. Will
*Assistant Examiner*—Alexandra Pechhold
(74) *Attorney, Agent, or Firm*—Antonelli, Terry, Stout & Kraus, LLP

(57) ABSTRACT

Pipe for great water depths allowing transfer of a fluid between a floating support and a point situated below and at a distance from the water surface, characterized in that it comprises:

at least one flexible part connected at one of its ends to the point situated below the surface, at least one rigid part connected to the flexible part at one of its ends and to the floating support at the second end, the rigid part being held up onto the floating support by holding means allowing this part to be essentially tensioned under the effect of its own weight.

13 Claims, 6 Drawing Sheets

U.S. PATENT DOCUMENTS 5,951,061 A * 9/1999 Arlt, III et al. ..... 285/94
5,971,075 A * 10/1999 Odru et al. ..... 166/367
6,030,145 A * 2/2000 Stewart, Jr. et al. ..... 405/172
6,146,052 A * 11/2000 Jacobsen et al. ..... 405/169
6,257,801 B1 * 7/2001 Kelm et al. ..... 405/224.2
6,276,456 B1 * 8/2001 Head ..... 405/224.2

* cited by examiner

HYBRID RISER OR PIPE FOR FLUID TRANSFER

FIELD OF THE INVENTION

The present invention relates to a production riser or riser pipe comprising a flexible part in the lower part thereof, connected to one or more effluent sources, and a rigid part in the upper part thereof.

The invention is particularly well-suited for petroleum effluent production systems, notably for oil and gas production, by using a floating support anchored to the sea bottom that is connected to one or more production wells by means of one or more production riser pipes or risers consisting of at least one rigid part in the upper part thereof and of a flexible part in the vicinity of the sea bottom. The pipes can be independent or connected to one another in the form of riser towers.

The invention also more generally relates to any pipe allowing to transfer or to carry a fluid from one place to another, fluid (water, gas . . . ) injection lines for example.

BACKGROUND OF THE INVENTION

Production systems are generally installed for relatively great lengths of time, 20 years for example. While they are installed and during production operations, they undergo outside stresses such as wave motion, current, wind. . . .

The floating support is usually anchored statically to the sea bottom by means of a series of chains or of vertical or oblique taut lines. In both cases, it retains a certain freedom of motion on and along various axes, that range from some centimetres to some metres for vertical displacements due to the wave motion, known in this field as heave, and up to several ten metres in the horizontal plane, known as surge, sway and slow drift. Rotations around the horizontal axes, roll/pitch, and around the vertical axis, yaw, depend on the dimensions of the floating support, on its anchor means, and on the wave motion, current and wind conditions.

Conventionally, in such installations, the riser pipes are fastened on the one hand to a subsea structure placed on the bottom and generally including several wellheads, and on the other hand they are directly or indirectly connected to a floating structure by means of suitable devices. These connecting devices make the riser pipes more or less dependent on the floating support and therefore on its displacements.

Using flexible risers is particularly well-suited for this type of displacements. They respond very well to the motions at the head (in the vicinity of the connection with the floating support) and the bottom contact is well controlled. The numerous applications of flexible risers implemented throughout the world and in the offshore sphere show that the fatigue aspects for this type of riser can be considered to be sufficiently controlled.

Dimensioning of flexible risers must take account of traction and collapse among other criteria. In deep seas, knowing that a flexible riser is generally heavier than a rigid one, combination of the two aforementioned criteria can become difficult to control.

For entirely rigid and practically vertical risers, suspension systems better known as tensioning systems are generally used so that these displacements can be borne by the riser pipe. Hydraulic tensioning or passive float tensioning systems that keep the riser pipe under more or less constant tension and independent of the motions of the support are for example used. These systems can become very cumbersome for risers at great depths.

Rigid riser systems known as catenary, that can be used in deep seas, use the flexibility of the metal over a great riser length in order to give them a shape similar to the conventional shape of the flexible. These risers can possibly be without tensioning means, but they have two major drawbacks:

- a great horizontal distance is required between the riser head and the subsea wellhead,
- the fatigue at the separation point is critical.

The prior art also describes various layouts notably intended to take up the motions of the floating supports by combining rigid part and flexible part for the riser system.

For example, hybrid risers such as those used in U. S. Pat. No. 4,661,016 or the Mobil/IFP Compliant riser presented for example in "Applications of Subsea Systems" (Goodfellow Associates Ltd, 1990) consist of a riser or of a tower of rigid risers extending from the sea bottom to a certain given depth. This depth is preferably below the turbulence level of the waves, where they are tensioned by means of a subsurface buoy. Their upper end is connected to flexible risers allowing to carry the fluids to a floating support. These risers take up the differential motions between the support and the buoy. There are other versions of this configuration where the rigid risers are catenary risers such as those described in U. S. Pat. No. 5,639,187.

SUMMARY OF THE INVENTION

The idea of the present invention is to design a pipe for great water depths allowing to transfer a fluid, the pipe connecting a floating support and the sea bottom for example, or a point located at a great depth below the floating support.

The pipe is notably characterized in that it comprises at least one flexible part connected to the sea bottom and at least one rigid part connected to the floating support, the rigid part and the flexible part being connected together. The length of the rigid part is at least equal to the distance between a point situated on the sea bottom and a point at the water surface. This distance is referred to, in the description hereafter, as "water depth" or "water layer" D.

The rigid part is for example connected to the floating support by suitable means allowing the pipe to be tensioned essentially under the effect of the own weight of the whole system, i.e. the riser and the rigid part carrying a fluid over the most part of water depth D.

The pipe can be a production riser for example.

In the description hereafter, the expression "its own weight" designates:

- the weight of the pipe or of the riser consisting of the various rigid and flexible parts, or
- the weight of the whole of these two parts and of the equipments associated with the pipe or with the riser, such as insulating elements, elements providing junction or connection between the various parts, or any other element completing the pipe or the riser.

Such a riser is well-suited for seas having depths greater than 500 m and more particularly greater than 1000 m, and for ultragreat depths.

The invention also relates to a pipe for great water depths allowing transfer of a fluid between a floating support and a point located below and at a distance from the water surface.

It is characterized in that it comprises:

- at least one flexible part connected at one of its ends to the point situated below the surface,
- at least one rigid part connected to the flexible part at one of its ends and to the floating support at the second end, the length of said rigid part being at least equal to half the water depth D.

According to a realization variant of the pipe, the flexible pipe is for example defined as follows:

a) the extreme motions of the floating support are established, b) the motions at the top of the flexible part are assumed to be substantially identical to the extreme motions, c) the position Ph of the upper end of this flexible part is so selected on the vertical axis that the length of the rigid part represents the most part of the water depth, and the flexible part is so dimensioned that it takes up at least the pre-established motions by taking account of at least the following parameters: the inside pressure Pint, the outside pressure Pext, the nature of the fluid, the maximum stresses such as the maximum traction Tmax undergone by the flexible part, the value of the allowable maximum curvature courbmax, if the flexible part does not meet the conditions of use, at least position Ph is changed, the rigid part is defined for given holding means and a diameter value Dr, e) its length Lr is selected substantially equal to the value of the distance existing, under equilibrium conditions, between the upper end of the flexible riser and the holding means, the value of its thickness is defined so as to take up the stresses generated by at least: the weight of the pipe, the weight of the suspended part of the flexible, the hydrodynamic stresses, the stresses induced by the displacements of the floating support, the inside and outside pressures, f) it is checked that the rigid part of the riser that is placed inside or on the edges of the floating support does not come into contact with a part of the floating support, and one possibly starts again from stage b).

The stages of dimensioning the flexible part and the rigid part are for example carried out under static conditions and static dimensioning can be checked by means of dynamic dimensioning stages.

According to another realization variant, the stages of dimensioning the flexible part and the rigid part are carried out under dynamic conditions.

The pipe can comprise heat insulation means placed on at least the rigid part and/or the flexible part.

The rigid part of said pipe is for example held up onto the floating support by holding means allowing the pipe to be tensioned under the effect of its own weight.

The invention also relates to a production riser or riser pipe intended for transfer of effluents from a production well to a support having for example at least one of the aforementioned characteristics of the pipe for great water depths allowing transfer of a fluid between a floating support and a point situated below and at a distance from the water surface.

The pipe according to the invention can also be an injection line where the rigid part is connected to a source of fluid to be injected and the flexible part is connected to a point where the fluid is to be injected.

The invention also relates to a system for producing petroleum effluents at great water depths, allowing transfer of a fluid between a floating support and a source of effluents, characterized in that it comprises at least one or more risers and one or more injection lines having at least one of the aforementioned characteristics relative to the pipe for great water depths allowing transfer of a fluid between a floating support and a point situated below and at a distance from the water surface.

The system can comprise at least one catenary anchor system applied onto the rigid riser in the vicinity of the junction and/or of the connector between the flexible part and the rigid part.

The system comprises for example additional tensioning means for the riser(s).

In relation to the devices of the prior art, a riser according to the invention notably affords the following advantages:

it does not require tensioning systems or means (such as a subsurface buoy) under normal working conditions, i.e. during production operations, and the rigid part is connected to the support only at the upper end thereof, unlike conventional hybrid pipes, the weight of a flexible pipe being generally greater than the weight of a rigid pipe, the layout of the flexible part and of the rigid part according to the invention notably allows to limit the tension at the head and therefore to extend the field of application of the flexible pipe to deeper seas, it uses proven properties of flexible pipes to solve fatigue problems in the vicinity of the separation point and of rigid pipes to solve the weight problem in very deep seas, in general, the rigid part of the riser will be longer than the flexible part, and heat insulation will be obtained more readily on the first part, it is not necessary to oversize the floating support as in the case of vertical rigid risers using hydraulic tensioners. The latter require tensioning systems by taking account of safety coefficients that lead to oversize the floating support, all the wellhead/floating support horizontal distances can be envisaged, which is not the case with vertical or catenary rigid risers.

BRIEF DESCRIPTION OF THE DRAWINGS

Other features and advantages of the present invention will be clear from reading the description hereafter, given by way of non limitative example, with reference to the accompanying drawings wherein.

DETAILED DESCRIPTION

Figure 1B:
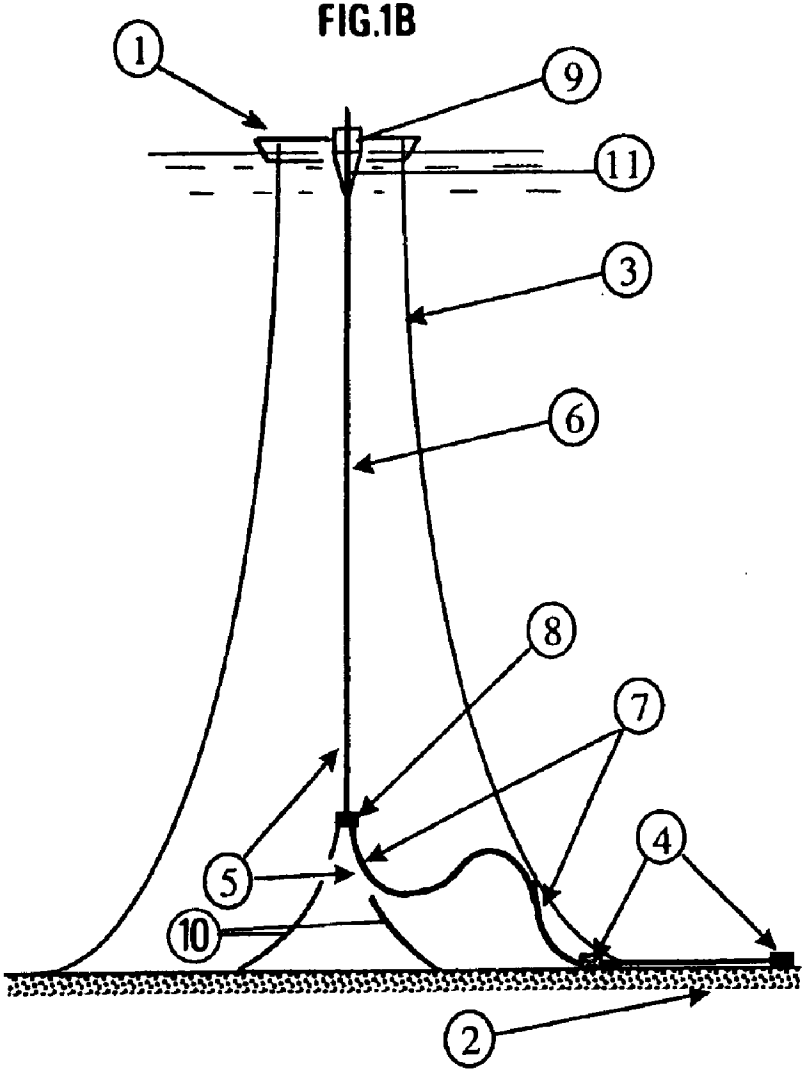
FIGS. 1A and 1B diagrammatically show two production system variants comprising a hybrid riser according to the invention, having respectively a) a "Pliant-wave"-shaped and b) a "Lazy-wave"-shaped flexible part, FIGS. 2 to 5 diagrammatically show various holding devices.
Figure 1A:
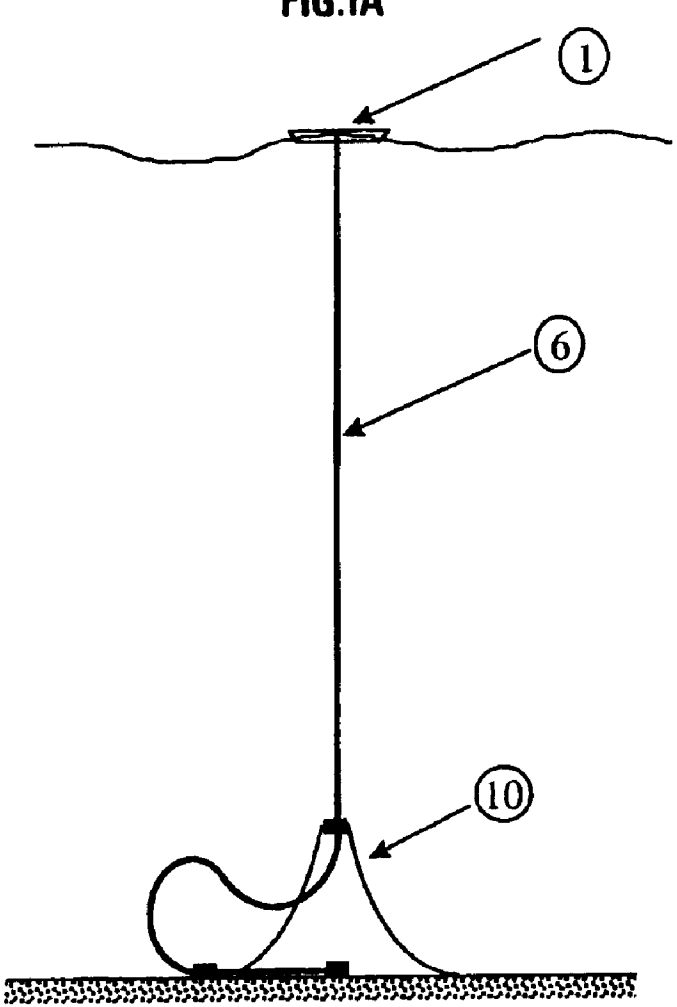

FIGS. 1A and 1B show two examples of production systems given by way of non limitative example in order to show the particular features of the layout of the various elements that constitute them.

These two figures mainly differ in the shape that can be taken by the flexible part of the hybrid riser according to the invention, which can be, for FIG. 1A, of "Pliant-wave " type, and for FIG. 1B, of "Lazy-wave" type. Some elements common to the two figures have the same reference numbers.

The production system comprises for example a floating support 1 anchored to sea bottom 2 by anchor means 3 such as an assembly of chains or taut lines, tendons for example. The support is for example positioned in the vicinity of one or more sources 4 of petroleum effluents, one or more production wells for example.

A riser 5 allowing to transfer the effluents from the source to the floating support consists for example of an upper rigid part 6 and of a lower flexible part 7 connected together by a connector 8.

The upper part or end 6B of the rigid part of the riser is fastened to floating support 1 by a holding device 9 allowing the rigid part of this riser to be tensioned mainly under the effect of the own weight of the whole of the riser.

Under normal working conditions, fastening or holding the rigid part in the vicinity of the floating support requires no tensioning system such as a subsurface buoy commonly used in the prior art between a riser and the floating support, or at the head of the rigid part of the riser.

Lower part 6A of the rigid part and upper part 7B of the flexible part are both connected to the connector.

This connector is so positioned that rigid length Lr is at least equal to half the water depth.

The flexible lower part is connected at its end 7A for example to the production wells by means of devices commonly used in the field of petroleum production and which will not be detailed here insofar as they are well known. It can also be connected to the production wells by means of flowlines.

Without departing from the scope of the invention, it is possible to place, for example in the vicinity of the junction between the rigid part and the flexible part, an element allowing to tension the riser when the weight thereof is not self-sufficient.

In order to limit horizontal motions at the bottom of the rigid part, one or more tendons 10 can be used and connected for example in the vicinity of the rigid riser part, slightly above connector 8. Dimensioning of these tendons will be achieved according to the predictable extreme motions of the floating support. Lateral motion of the riser can be limited, for example, to the predictable extreme maximum excursion of the floating support.

A stress limiter 11 is possibly added below holding device 9, in the vicinity of the floating support. It notably allows to minimize the curvature effects and stresses undergone by the riser under the effect of the wave motion, of the hydrodynamic forces and of other outside elements. It is suited, over at least part of its length, to withstand at least the stresses induced by the strains transmitted by the marine environment, those induced by the holding device and the stresses due to the weight of the loads taken up by the limiter.

This stress limiter can be, for example, conical or consisting of several cylindrical sections of variable thickness. It is preferably positioned just below the lower connection of the riser to the floating support, therefore on the rigid part.

The stress limiter can be an integral part of the rigid part of the riser or it can be a sheath thereof.

The shape of the flexible riser can be one of the conventional shapes of flexible risers such as, for example, "free-hanging", "lazy-S", "lazy-wave", "steep-S", "steep-wave"or "pliant wave". The known properties of the flexible can thus be used for dimensioning this flexible part, in particular for fatigue resistance.

The riser according to the invention is for example defined at least by the following parameters:

- a flexible part of length Lf, of thickness ef, of diameter Df,
- a rigid part of length Lr, of thickness er, of diameter Dr, and
- the length Lr of the rigid part is at least equal to half the water depth "D" (distance between floating support 1 and sea bottom 2).

The diameters considered can be the inside or the outside diameters of the various parts.

The nature of the materials forming the rigid part and the flexible part of the riser are for example selected according to the fluid carried in the riser.

They are for example resistant to $H_2S$, or to any other compound or product likely to damage the riser on its flexible part or on its rigid part.

Dimensioning of the riser or of the riser system can be carried out in several stages by taking account of known parameters, for instance as follows, for a dimensioning procedure under static conditions by way of non limitative example.

Quasi-static extreme conditions (where inertia effects are disregarded) are for example selected, these conditions can be given by a combination of maximum roll or pitch angle values or by unusual current values such as hundred-year currents, associated with extreme offset values of the floating support, in accidental cases such as a broken tendon for example.

The offset values can be measured by means of an offset angle taken in relation to a given axis, or in relation to a point of the floating support, offset angle a counted in relation to a vertical axis and values amin and amax are for example considered. They can also be selected as a percentage of the depth as imposed by certain standards.

The vertical motion of the floating support can also be taken into account.

Dimensioning Stages Under Static Conditions for Example a) the extreme horizontal and vertical excursions of the floating support that will be established from the start (extreme offset values of the floating support), amin and amax, b) it is for example assumed that the top of the flexible part of the riser will follow the pre-established excursions to the maximum, c) dimensioning the flexible part of the riser by means of dimensioning methods known to the man skilled in the art in order to take up these pre-established motions and by taking account of at least the following data:

- the position of the upper end of the flexible part, Ph, is so selected on the vertical axis that the length of the suspended rigid part is at least equal to half the water depth D, but it can even be equal to 9/10 of the water depth or more according to the depths considered,
- the flexible part is given a shape according notably to the system in which it is used (number of risers, positioning of some in relation to others, number and position of the wells),
- the inside pressure Pint resulting from the circulation of the fluid circulating in the riser, and the imposed pressures,
- the outside pressure Pext exerted by the environment on the riser, which notably depends on the water depth considered, the maximum traction Tmax envisaged, the flexible part undergoing traction notably because of its own weight, and the substantially vertical extreme excursion, the maximum curvatures not to be exceeded, over the length of the flexible part, a limiting value courbmax not to be exceeded is selected according to the composition of the flexible part, possibly the maximum torsion envisaged, it is checked that the flexible part meets the conditions of use and, in the opposite case, at least one of the parameters is changed, the vertical position of the upper end of the flexible part or the shape of the flexible part, d) selecting a holding device provided on the floating support, it can be of knuckle type such as a flex joint, or a fastening and holding device such as those described in FIGS. 2 to 5, for example, e) dimensioning the rigid part the diameter Dr of the rigid part is selected according to users' needs, length Lr is selected substantially equal to the value of the distance between the upper end of the flexible riser and the holding device provided on the floating support, considering the system under equilibrium conditions, this value representing a major part of the water depth as defined at stage c), the thickness er of this part is defined to take up at least all the stresses generated by: the riser weight, the strain exerted by the flexible part in the vicinity of the connector connecting the two parts or in the vicinity of the junction itself, the hydrodynamic strains exerted by the environment (wave motion, current, . . . ), the stresses induced by displacements of the floating support, the inside and outside pressures defined above and exerted on the two parts of the riser, the torsion likely to . . . and the type of holding device used in the vicinity of the floating support. Calculations allowing to determine the thickness require conventional methods known to the man skilled in the art, f) it is checked that the rigid part of the riser placed inside the floating support does not come into contact with a part of the latter. In the opposite case, the holding device type or the position of the fastening point of the rigid part of the riser on the floating support is changed, and the stages are repeated for example from stage b).

The bending strength of the flexible riser is checked for given storage or setting conditions for example.

When the riser is provided with a stress limiter 11 situated in the vicinity of the rigid part and of the floating support, for example according to a layout described in FIG. 1B, this limiter is for example dimensioned so as to retain a constant curvature at this junction; the value of the curvature must be lower than the maximum curvature allowed by the rigid part of the riser.

The flexural stresses and/or the Von Mises stresses must meet the standards in force in the sphere where the riser is used.

Stages a) to f) are for example carried out within the scope of static calculations, by considering the aforementioned most unfavourable configuration instances such as, for example, maximum roll or pitch angle at the head associated with a hundred-year current in the direction interfering with the trend of this angle.

Stages of Dynamic Control of the Riser Dimensioning Performed Under Static Conditions After dimensioning the riser under static conditions and by means of the previous stages, dynamic analysis is performed to control the riser dimensioning according to standards in force.

It is notably checked that, under the dynamic heave effects that are not necessarily taken into account in the static dimensioning stages, the maximum traction remains acceptable.

If excursions of the junction points of the flexible and rigid parts remain lower than those predicted but if the dynamic effects are great and the standards are not met, notably as regards stresses and fatigue, the riser is dimensioned again by starting from stage c) again and under dynamic conditions.

Dynamic analysis can be carried out in relation to the behaviour of the junction point between the rigid and flexible parts, of the fastening at the head of the rigid part or of both.

For example, if dynamic analysis shows that the bottom of the rigid part of the riser corresponding to the junction point of the two parts has a greater excursion than that of the floating support, at least three cases can be considered:

Case 1

The excursion of the junction point of the two parts corresponding to the bottom of the rigid part remains acceptable from the viewpoint of dimensioning criteria for the rigid part and the flexible part, dimensioning is not modified.

Case 2

The excursion is not acceptable, a first variant consists in adding motion-limiting tendons that are placed between the level of the connector or of the junction of the flexible part and of the rigid part, and the ground.

The tendon lengths are for example calculated so that, when taut, excursion of the connector is limited in relation to that of the floating support and only slightly greater. The strains induced in these tendons are thereafter calculated by means of dynamic simulations in order to correctly dimension the tendons. It is thereafter checked that there never is any interference between the riser and the tendons.

Case 3

When it is not possible to use tendons and when certain criteria relative to the conditions of use of the flexible riser are no longer met (too great a curvature for example), dimensioning of the flexible riser is started again from stage b) by taking account, for excursion parameters, of higher values than that of the floating support (initially given excursion values ).

In general the length Lr of the rigid part of the riser is for example so selected that its lower end 6A is situated right below the lowest level of the floating support. D being the water depth taken at the level of the floating support, H the height of the floating support, Hf the height of the upper end 7B of the flexible part in relation to the sea bed, value Lr is greater than H, and ratio Lr/Hf is preferably greater than 3 for depths greater than 1500 m, ratio Lr/D is for example greater than 0.5 and can reach 0.95 or more according to the depth and to the environment conditions and the motions at the head.

Figure 2:
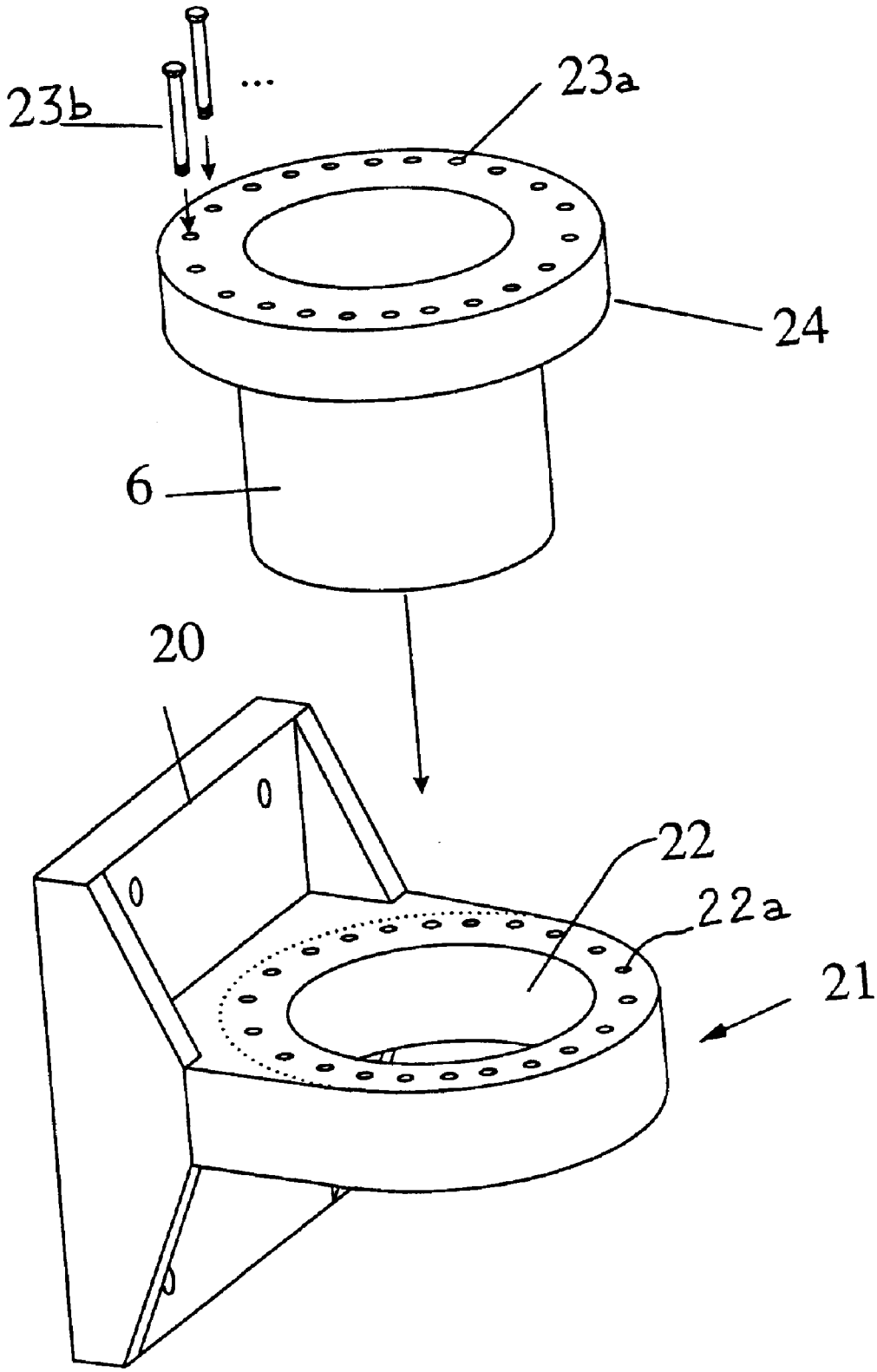
FIG. 2 shows the simplest holding device where the riser must be driven in and the flange is screwed on, FIG. 3 shows a holding device where the clamp can open and the flange is screwed on, FIG. 4 shows a holding device where the clamp opens and which is provided with a slot, thus allowing axial rotation.

FIG. 2 shows a first method of fastening the upper part 6 of the riser to floating support 1.

The floating support is therefore equipped with a holding means comprising a plate 20 secured to the floating support for example, provided with a part 21 substantially perpendicular to plate 20. Part 21 is provided with an opening 22 allowing passage of the riser or the stress limiter and with various fastening means, in the present case holes 23*a* allowing to fasten screws or any other fastening means.

The upper part of the riser or of the stress limiter is equipped with a flange 24 or ring itself provided with holes intended to receive means 23*b* for fastening the flange onto the part secured to the floating support.

Plate 21 can advantageously comprise a stress limiter fastened to its lower face for example.

The height of part 21 can be more or less great according to the stresses to be taken up.

Figure 3:
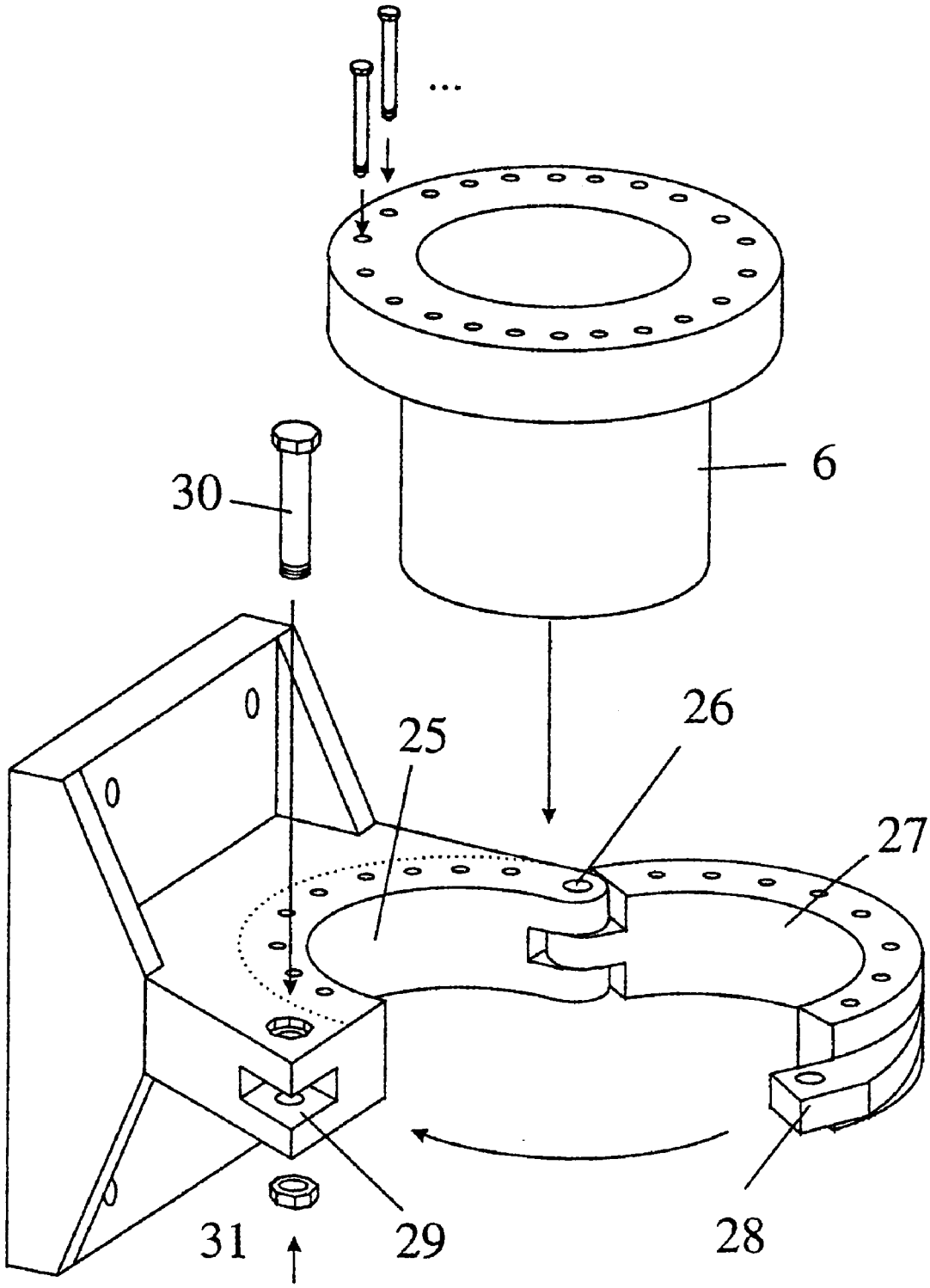

FIG. 3 shows another realization variant for the riser holding device.

Part 21 of FIG. 2 is replaced by a plate comprising a semi-circle 25 suited to the shape and the dimensions of the riser or of the stress limiter, a hinge 26, and another semi-circular part 27 provided with a part 28 that closes in a notch 29. Fastening means in the vicinity of the notch, for example a bolt consisting of a screw 30 and a nut 31, allow holding of the upper part of the riser. A clamp that can be readily opened is thus formed, hence easy setting of the riser.

The height of this clamp can vary according to the stresses to be taken up.

Figure 4:
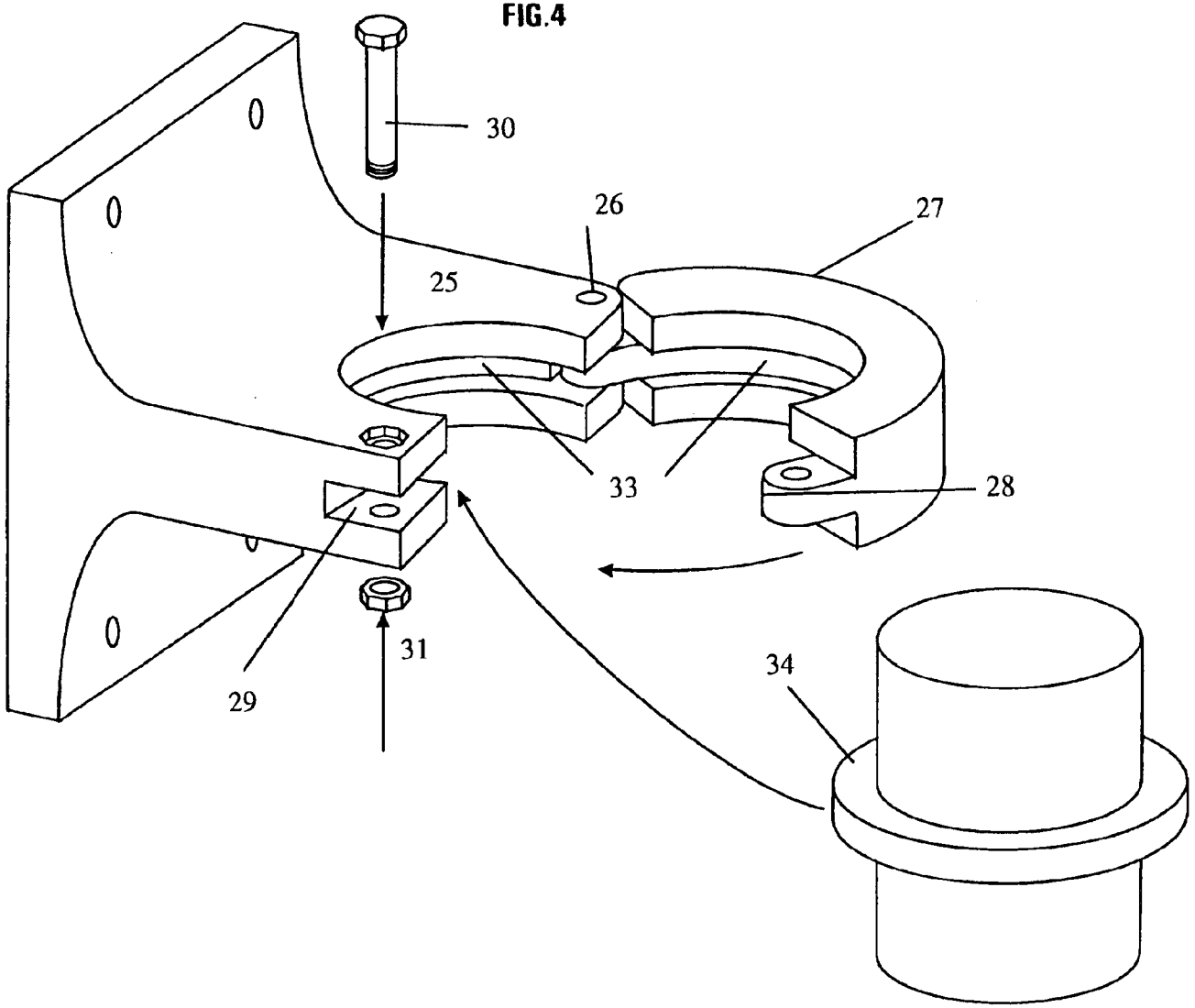

FIG. 4 shows a realization variant of the holding device of FIG. 3 where each semi-circular part is provided, on the inner wall thereof, with a groove 33 whose dimensions are suited to flange 34 situated on the upper part of the riser.

Figure 5A:
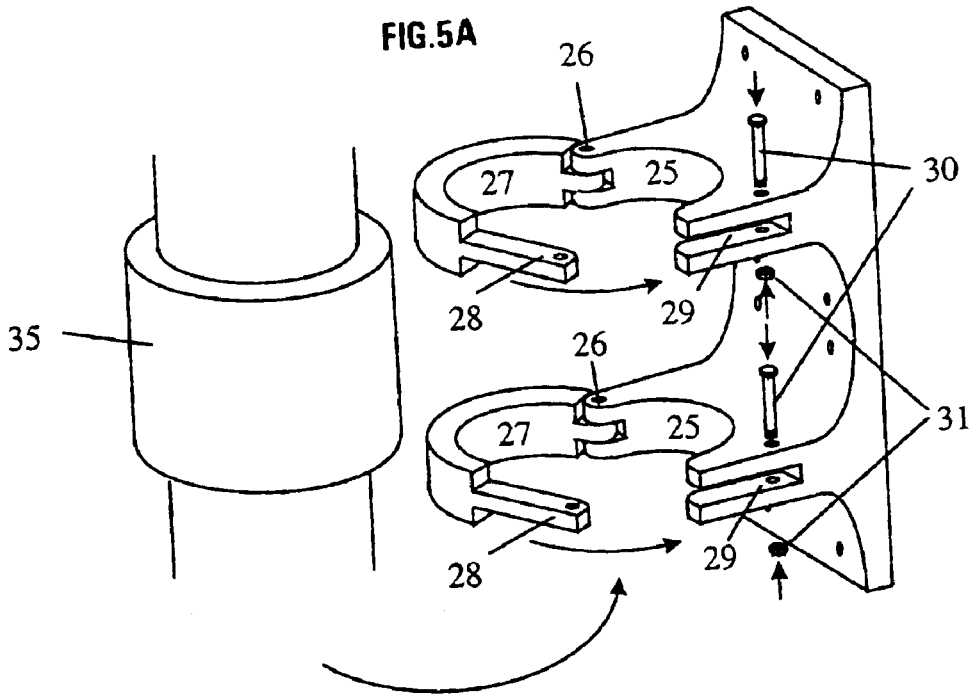
FIGS. 5A and 5B show two realization variants for the holding device comprising two openable clamps holding a) one or b) two flanges, and FIG. 6 diagrammatically shows a production system comprising several risers.
Figure 5B:
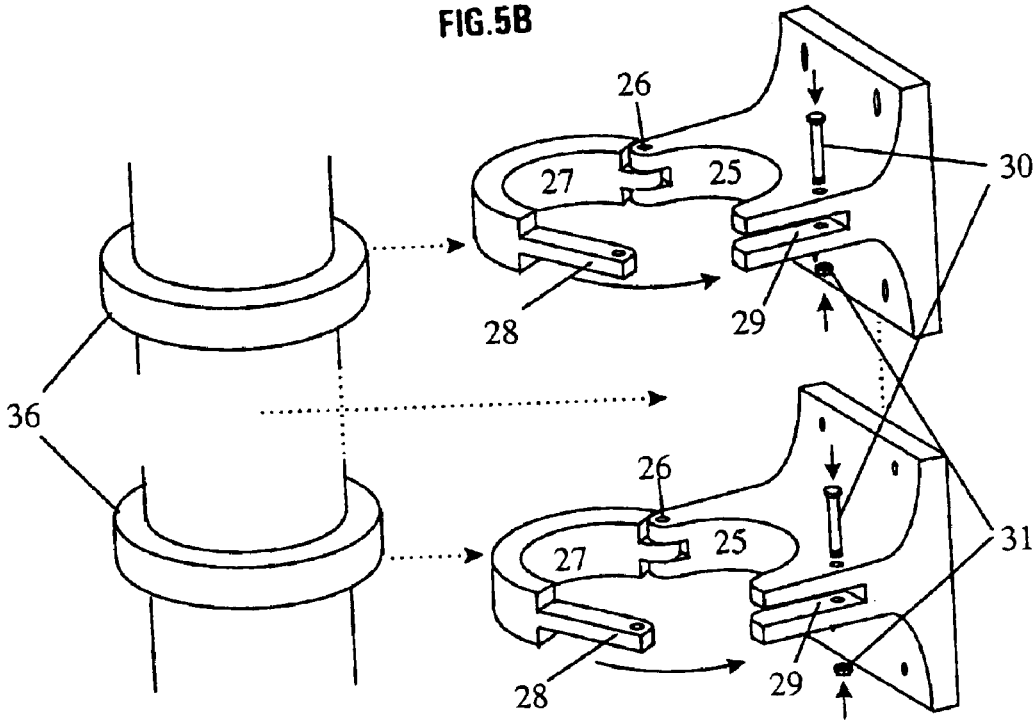

FIGS. 5A and 5B show two realization variants of the holding device of FIG. 4. The groove in a single clamp is replaced by two clamps that hold a dog 35 (FIG. 5A) or two dogs 36 (FIG. 5B) if the clamps are relatively distant from one another.

Figure 6:
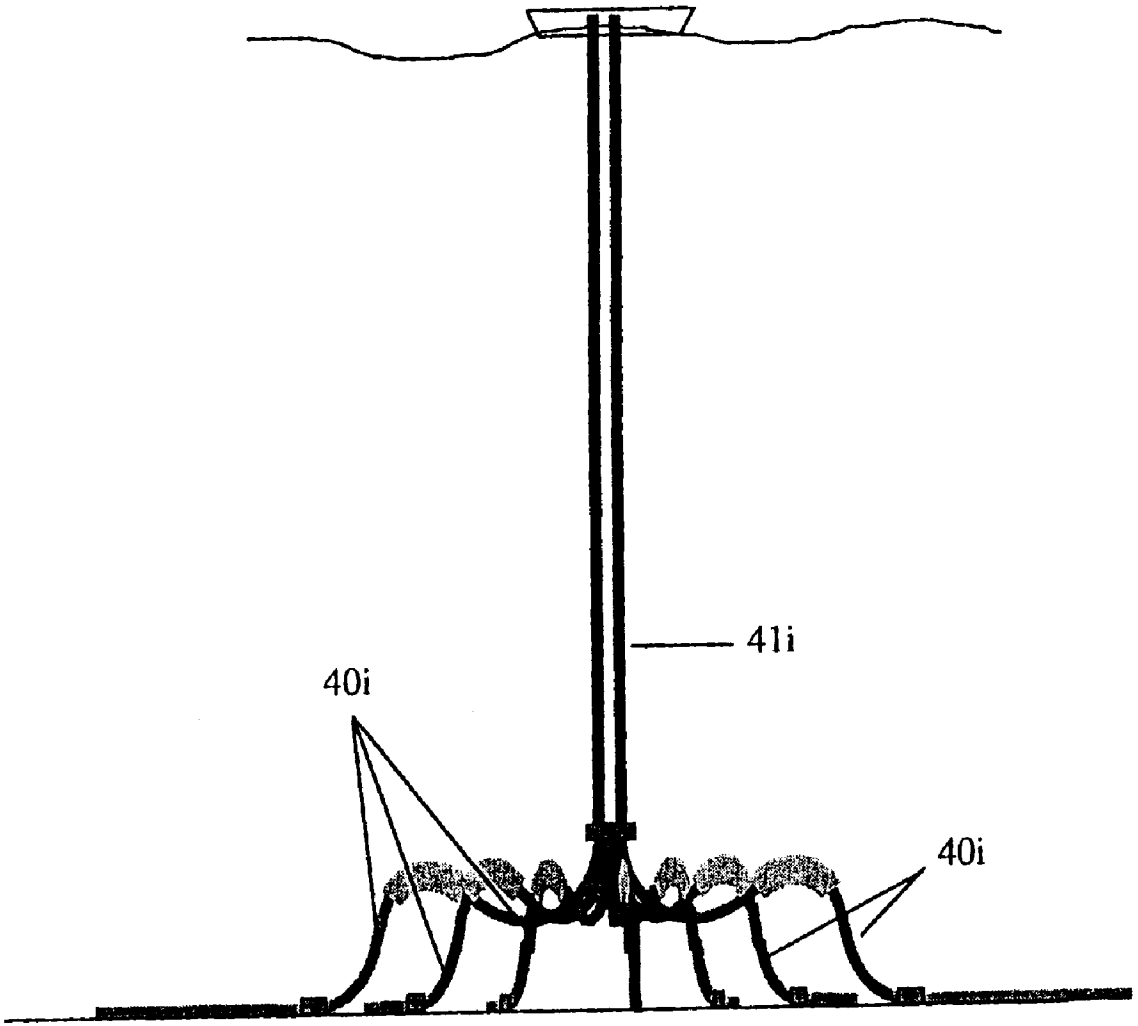

FIG. 6 diagrammatically shows an example of application of the invention for petroleum production using several hybrid risers.

Each riser comprises a rigid part 41*i* and a flexible part 40*i* determined according to the method described above.

A flexible part can be connected to a rigid part by a connector, the risers being autonomous in relation to each other, the connector being placed closer to the sea bottom than to the surface.

Without departing from the scope of the invention, it is also possible to group the various flexible parts together in the vicinity of a connector, and the latter can be in connection with a bundle grouping together the rigid parts of the risers or with a tower of rigid risers.

According to another realization variant, several flexible parts can be grouped together by a connector so as to be connected to a single rigid part fastened in the vicinity of the floating support.

Without departing from the scope of the invention, the rigid part comprises heat insulation means for example.

It is also possible to use, for the flexible part of the riser, a flexible riser provided with insulating or heating means.

Using heating or insulating means on at least one of the two parts advantageously allows to prevent or to minimize deposit formation, for example hydrates or paraffins within the scope of production of a petroleum effluent in deep seas for example.

The materials forming the rigid part and the flexible part of the riser are selected according to the fluid carried within, so as to prevent risks of damage such as corrosion or any other damage resulting from the action of the fluid on the riser.

What is claimed is:

1. A pipe for great water depths allowing transfer of a fluid between a floating support and a point located below and at a distance from the water surface, characterized in that it comprises:

a continuously flexible riser part connected, at one end, to the point located below the surface, and a rigid riser part connected to the flexible riser part at one end and to the floating support at the second end thereof, said rigid riser part having a length at least equal to half the water depth, and further including a catenary anchor system applied to the rigid riser part in the vicinity of a junction between the flexible riser part and the rigid riser part or in the vicinity of a connector between the flexible riser part and the rigid riser part, the catenary anchor system comprising one or more tendons anchored to a sea bottom, wherein the pipe is an injection pipe or line and characterized in that the rigid riser part is connected to a source of fluid to be injected and the flexible riser part is connected to a point where the fluid is to be injected.

2. A system for producing petroleum effluents in great water depths allowing fluid transfer between a floating support and a source of effluents, characterized in that the system comprises at least one or more risers and/or one or more injection lines, and wherein each of the one or more risers and/or one or more injection lines is a pipe for great water depths (D) allowing transfer of a fluid between a floating support (1) and a point located below and at a distance from the water surface, characterized in that it comprises:

a continuously flexible riser part (7) connected, at one end, to the point located below the surface, and a rigid riser part (6) connected to the flexible riser part at one end and to the floating support at the second end thereof, said rigid riser part (6) having a length at least equal to half the water depth, further comprising a catenary anchor system (10) applied to the rigid riser part in the vicinity of a junction between flexible riser part (7) and rigid riser part (6) and/or in the vicinity of connector (8) between flexible riser part (7) and rigid riser part (6) and anchored to a sea bottom.

3. The system of claim 2, wherein at least one of said one or more risers further comprises heat insulation means placed on at least the rigid riser part and/or the flexible riser part.

4. The system of claim 2, wherein at least one of said one or more risers is characterized in that said rigid riser part is held up to the floating support by holding means (9) allowing said pipe to be tensioned under the effect of its own weight.

5. The system of claim 2, further comprising additional means for tensioning the riser(s).

6. A pipe for great water depths allowing transfer of a fluid between a floating support and a point located below and at a distance from the water surface, characterized in that it comprises:

at least one flexible riser part connected, at one end, to the point located below the surface, and at least one rigid riser part connected to the flexible riser part at one end and to the floating support at the second end thereof, said rigid riser part having a length at least equal to half the water depth, and a catenary anchor system applied to the rigid riser part in the vicinity of a junction between the flexible riser part and the rigid riser part or in the vicinity of a connector between the flexible riser part and the rigid riser part, the catenary anchor system comprising one or more tendons anchored to a sea bottom.

7. The pipe of claim 6, wherein said pipe further comprises heat insulation means placed on at least the rigid riser part and/or the flexible riser part.

8. The pipe of claim 6, wherein said pipe is characterized in that said rigid riser part is held up to the floating support by holding means allowing said pipe to be tensioned under the effect of its own weight.

9. The pipe of claim 6, wherein the pipe is an injection pipe or line and wherein the rigid riser part is connected to a source of fluid to be injected and the flexible riser part is connected to a point where the fluid is to be injected.

10. A method of designing a pipe in a system as claimed in claim 2, and for use in a body of water that exerts stresses on the pipe and the floating support due to wave motion, current and wind, the stresses thereby causing motions in the pipe and/or the floating support, and wherein the flexible riser part will have a definable internal pressure resulting from the conveying of the particular fluid, a definable external pressure resulting from the water depth, a definable maximum traction resulting from stresses from the body of water, and a definable maximum allowable curvature, resulting from the composition of the flexible riser part, and wherein the rigid riser part has a defined holding means wherein it can be connected inside or on an edge of the floating member without coming into contact with the floating member, and wherein the rigid riser part has a defined diameter, and wherein the rigid riser part is subject to stresses generated by the weight of the pipe, the suspended weight of the flexible part, hydrodynamic strains, strains induced by displacements of the floating support, inside pressures and outside pressures, the method comprising the steps of A) defining the flexible riser part by the steps of a) determining extreme motions that the floating support would be subjected to in the body of water and assuming that extreme motions at an end of the flexible riser part where it is connected to the rigid riser part are substantially identical to the extreme motions of the floating support, and b) selecting a point (Ph) along a vertical axis that coaxial to the axis that the rigid riser part will have when the rigid riser part is connected to the floating support, wherein the first point (Ph) is closer to the bottom of the body of water than to the top of the body of water and determining whether the point (Ph) can serve as the location where the flexible riser part is connected to the rigid riser part, the determining taking into account the extreme motions that the end of the flexible riser part where it is connected to the rigid riser part would be subjected to, as determined by step (a), and further taking into account the inside pressure, the exterior pressure, the nature of the fluid, the maximum traction of the flexible riser part and the maximum allowable curvature, wherein, if point (Ph) cannot serve as the location where the flexible riser part is connected to the rigid riser part, the step (b) is repeated with one or more additional points, until a point is found that can serve as the location where the flexible riser part is connected to the rigid riser part, B) defining the rigid riser part by the steps of a) selecting the length of the rigid riser part so that the length is substantially equal to the value of a distance, under equilibrium conditions, between the upper end of the flexible riser and the holding means, so that length of the rigid riser part is at least equal to half the depth of the water depth, b) selecting the thickness of the rigid riser part by taking into account stresses generated by the weight of the pipe, the suspended weight of the flexible riser part, hydrodynamic strains, strains induced by displacements of the floating support, inside pressures and outside pressures, and c) checking that the rigid riser part when the rigid riser part is connected by the holding means inside or on an edge of the floating support, the rigid riser part does not come into contact with the floating support, and wherein if the rigid riser part does contact the floating support, steps A) and B) are repeated with different values for the point (Ph).

11. The method of claim 10, wherein steps A) and B) of defining of the flexible riser part and the rigid riser part are carried out under static conditions.

12. The method of claim 11, wherein the outcome of steps A) and B) of defining of the flexible riser part and the rigid riser part under static conditions is checked by means of dynamic dimensioning stages.

13. The method of claim 10, wherein steps A) and B) of defining of the flexible riser part and the rigid riser part are carried out under dynamic conditions.

* * * * *